US007635668B2

(12) United States Patent
Clason

(10) Patent No.: US 7,635,668 B2
(45) Date of Patent: Dec. 22, 2009

(54) HYDRAULIC COMPOSITION CONTAINING A SUBSTANTIALLY NITROGEN FREE DISPERSANT

(75) Inventor: Donald L. Clason, Mentor, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 230 days.

(21) Appl. No.: 10/802,990

(22) Filed: Mar. 16, 2004

(65) Prior Publication Data

US 2005/0209112 A1 Sep. 22, 2005

(51) Int. Cl.
*C10M 129/72* (2006.01)
*C10M 137/10* (2006.01)
*C10M 169/04* (2006.01)
*C10M 133/44* (2006.01)

(52) U.S. Cl. ..... 508/506; 508/371; 508/280

(58) Field of Classification Search ..... 508/280, 508/506, 371

See application file for complete search history.

(56) References Cited

U.S. PATENT DOCUMENTS

| | | | | |
|---|---|---|---|---|
| 3,381,022 A | | 4/1968 | LeSuer | 260/404.8 |
| 3,697,427 A | * | 10/1972 | Byford et al | 508/281 |
| 3,708,522 A | * | 1/1973 | LeSuer | 560/198 |
| 3,804,763 A | | 4/1974 | Meinhardt | 252/51.5 A |
| 4,029,587 A | | 6/1977 | Koch | 252/48.2 |
| 4,031,118 A | | 6/1977 | Miller | 260/404.5 |
| 4,032,303 A | | 6/1977 | Dorer, Jr. et al. | 44/70 |
| 4,159,958 A | | 7/1979 | De Vries | 252/33.4 |
| 4,244,279 A | * | 1/1981 | Stewart et al. | 91/488 |
| 4,466,894 A | | 8/1984 | Grover | 252/32.7 E |
| 5,334,329 A | | 8/1994 | Vinci et al. | 252/49.6 |
| 5,498,809 A | * | 3/1996 | Emert et al. | 585/13 |
| 5,652,201 A | * | 7/1997 | Papay et al. | 508/228 |
| 6,419,041 B1 | * | 7/2002 | Nemoto | 180/377 |
| 2002/0032127 A1 | | 3/2002 | Clement et al. | 508/192 |

FOREIGN PATENT DOCUMENTS

| | | |
|---|---|---|
| EP | 1213341 A1 | 6/2002 |
| GB | 2 111 526 A | 7/1983 |
| WO | WO 85/01514 | 4/1985 |

OTHER PUBLICATIONS

"Hybrid Hydraulic Powertrains: State of the Art and a Vision of the Future", (Brad Bohlmann, Eaton Corporation, SAE TOPTEC Symposium on Emerging Transmission Technologies, Aug. 13, 2003).
PCT Search Report for corresponding International Application No. WO 2005/007584—date of mailing of Search Report: Jul. 1, 2005.

* cited by examiner

*Primary Examiner*—Glenn Caldarola
*Assistant Examiner*—Jim Goloboy
(74) *Attorney, Agent, or Firm*—Christopher D. Hilker; David M. Shold

(57) ABSTRACT

The present invention provides a composition containing (a) a substantially nitrogen free dispersant derived from the reaction product of: (i) a polyalkenyl-substituted acylating agent; and (ii) a polyol; (b) a primary metal hydrocarbyl dithiophosphate; (c) an oil of lubricating viscosity; and (d) optionally a viscosity modifier, wherein the composition contains about 35 ppm or less of nitrogen derived from a substantially nitrogen free dispersant. The invention further provides a process for preparing the composition and its use.

13 Claims, No Drawings

HYDRAULIC COMPOSITION CONTAINING A SUBSTANTIALLY NITROGEN FREE DISPERSANT

FIELD OF INVENTION

The present invention relates to a composition containing a dispersant from the reaction product of (i) a polyalkenyl-substituted acylating agent; and (ii) a polyol, wherein the dispersant is substantially nitrogen free. The invention further provides a process for making the composition and a method for lubricating a vehicle hydraulic system.

BACKGROUND OF THE INVENTION

It is known to add dispersants with demulsifying and/or emulsifying characteristics to a lubricating composition. Dispersants are known to provide compositions with resistance to rust, prolonged cleanliness, decreased sludge accumulation, demulsification properties and varnish reduction. Dispersants with emulsifying characteristics are disclosed in U.S. Pat. Nos. 3,804,763, 4,031,118 and British Patent Application GB 2,111,256.

U.S. Pat. No. 3,804,763 (Meinhardt) and German Patent DE 2,360,117 (Meinhardt) disclose compositions containing a dispersant derived from a carboxylic acylating agent having at least 30 aliphatic carbon atoms per molecule with effective amounts of (a) a hydroxy compound and (b) a polyoxyalkylene polyamine. Optionally the dispersant is further reacted with an alkylene polyamine.

U.S. Pat. No. 4,031,118 (Clark) discloses a lubricant containing an ester prepared by reacting (a) a high molecular weight carboxylic acid acylating agent; (b) a polyoxyalkylene alcohol emulsifier for aqueous emulsions and optionally a polyhydric alcohol. The reaction product may be present at 0.1 to 20 weight percent of the composition.

British Patent Application GB 2,111,256 (LeSuer) discloses a composition containing a hydroxyamine and a carboxyl containing dispersant. The carboxyl containing dispersant may be prepared from a succinic acid and an alcohol such as pentaerythritol.

Conventional hydraulic fluids do not entrain water or emulsify water to enable separation of water an oil in hydraulic equipment which allows for removal. Dispersants are capable of providing fluids with the ability to entrain water or to create emulsions thereby by allowing for water to be removed. Once the water is entrained it is possible to remove water by evaporation or by other means. However, dispersants containing amino groups are known to be susceptible to aggressively react with the polymers used in seals used in original equipment manufacturer (OEM) hardware such as hydraulic equipment such as hydraulic launch assist equipment fitted to vehicles or hydrostatic transmissions and the like. Often the aggressive reaction between the amino group and the seal results in the seals becoming brittle and/or heavily corroded, which is undesirable due to potential damage to OEM hardware including a hydraulic system or significant down time for repairs.

Furthermore, hydraulic equipment such as hydraulic launch assist or a hydrostatic transmission prefers a hydraulic fluid which is capable of providing a fill for life (often referred to as a long life) fluid. Such hydraulic fluids therefore be able to have good low temperature viscometrics, good high temperature viscometrics and decrease wear.

U.S. Pat. No. 4,466,894 (Grover) discloses a composition containing (a) a metal salt of a phosphorodithioic acid; (b) an aliphatic or alicyclic acid; (c) a sulphurised metal phenate; and (d) a triazole. The composition also contains an emulsifying dispersant derived from a pentaerythritol ester with polybutenyl succinic acid reacted with alkylene polyamine. The emulsifying dispersant contains more than one succinic group per polybutenyl group. However, the composition disclosed is thermally unstable and as a result does not have a long life.

It is desirable to have a composition with good low temperature viscometrics and good high temperature viscometrics. The present invention provides a composition with good low temperature viscometrics and good high temperature viscometrics.

It is desirable to have a composition that is thermally stable and with a long life. The present invention provides a composition that is thermally stable and with a long life.

SUMMARY OF THE INVENTION

The present invention provides a composition comprising:

(a) a substantially nitrogen free dispersant derived from the reaction product of:
  (i) a polyalkenyl-substituted acylating agent; and
  (ii) a polyol;
(b) a primary metal hydrocarbyl dithiophosphate;
(c) an oil of lubricating viscosity; and
(d) optionally a viscosity modifier, wherein the composition contains about 35 ppm or less of nitrogen derived from a substantially nitrogen free dispersant.

The invention further provides a method for lubricating a vehicle hydraulic system capable of transferring rotational energy into a stored energy reservoir and later reconverting the stored energy to rotational energy to aid propulsion, the method employing a composition comprising:

(a) a substantially nitrogen free dispersant derived from the reaction product of:
  (i) a polyalkenyl-substituted acylating agent; and
  (ii) a polyol; and
(b) an oil of lubricating viscosity.

The invention further provides a process for the preparation of a composition comprising mixing:

(a) a substantially nitrogen free dispersant derived from the reaction product of:
  (i) a polyalkenyl-substituted acylating agent; and
  (ii) a polyol;
(b) a primary metal hydrocarbyl dithiophosphate;
(c) an oil of lubricating viscosity; and
(d) optionally a viscosity modifier, wherein the composition contains about 35 ppm or less of nitrogen derived from a substantially nitrogen free dispersant.

The use of the composition of the invention imparts one or more performance characteristics including improved cleanliness, decreased wear, improved shear stability, improved low temperature viscometrics, high temperature viscometrics or long life.

DETAILED DESCRIPTION OF THE INVENTION

The present invention provides a composition comprising:

(a) a substantially nitrogen free dispersant derived from the reaction product of:
  (i) a polyalkenyl-substituted acylating agent; and
  (ii) a polyol;
(b) a primary metal hydrocarbyl dithiophosphate;
(c) an oil of lubricating viscosity; and
(d) optionally a viscosity modifier, wherein the composition contains about 35 ppm or less of nitrogen derived from component a substantially nitrogen free dispersant.

Substantially Nitrogen Free Dispersant

As used herein the term "substantially nitrogen free" means the dispersant contributes about 35 ppm or less, in one embodiment about 25 ppm or less, in another embodiment about 15 ppm or less and in another embodiment about 5 ppm or less nitrogen to the composition. In one embodiment of the invention substantially nitrogen free dispersant is free of nitrogen.

The invention includes a substantially nitrogen free dispersant that exhibits emulsifying properties and is derived from the reaction product of: (i) a polyalkenyl-substituted acylating agent, such as, dicarboxylic acid anhydride or derivatives thereof; and (ii) a polyol. The substantially nitrogen free dispersant are prepared by a process described in U.S. Pat. Nos. 3,804,763, 4,031,118 and British Patent Application GB 2,111,256.

The polyalkenyl group includes a group derived from an olefin with a number average molecular weight of about 350 to about 10,000, in one embodiment about 400 to about 7000, in another embodiment about 500 to about 5000 and in yet another embodiment about 500 to about 4000. In one embodiment the long chain polyalkenyl group is a polyisobutylene group, which has a number average molecular weight from about 800 to about 1600 and in another embodiment from about 1601 to about 3000.

The acylating agent includes an acid group $(—COOH)_n$ or derivatives thereof, wherein the acylating agent is bonded through the carbon atom to a polyalkenyl group and n in one embodiment is 1 to about 8 and in another embodiment 1 to about 3, for instance 2. The acylating agent derivatives include an acid chloride, an anhydride, an ester or mixtures thereof. The number of carbon atoms in the acid group includes in one embodiment about 15 or less, in another embodiment about 10 or less and in yet another embodiment about 6 or less, for instance, 3, 4 or 5.

Examples of an acylating agent has an acid group derived from (meth) acrylic acid, maleic acid, maleic anhydride, methyl maleic anhydride, ethyl maleic anhydride, dimethyl maleic anhydride, fumaric acid, itaconic acid itaconic anhydride, citraconic acid, citraconic anhydride, mesaconic acid or mixtures thereof.

The polyol includes a polyoxyalkylene glycol, a polyhydric alcohol or mixtures thereof. The polyhydric alcohol includes those defined as $R^1—(OH)_m$, wherein m is the number of hydroxyl groups and $R^1$ may be an alkyl group, a phenyl group, a naphthyl group or mixtures thereof. $R^1$ contains in one embodiment 1 to about 10, in another embodiment about 2 to about 8 and in yet another embodiment about 2 to about 6 carbon atoms, for instance, 2 or 3 or 5 or 6 carbon atoms.

Example of suitable polyol compounds include an aliphatic polyol, such as, an alkylene glycol, an alkane polyol, a polyhydric phenol, a polyhydric naphthol or mixtures thereof.

Examples of suitable polyol compounds include an ethylene glycol, a propylene glycol, a trimethylene glycol, a butylene glycol, a glycerol, a monomethyl ether of glycerol, a 9,10-dihydroxystearic acid, an ethyl ester of 9,10-dihydroxystearic acid, a 3-chloro-1,2-propanediol, a 1,2-butanediol, a 1,4-butanediol, a 2,3-hexanediol, a 2,3-hexanediol, a pinacol, trimetholpropane (TMP), neopentyl glycol (NPG), a pentaerythritol, an erythritol, an arabitol, a sorbitol, a mannitol, a cresol, a heptylphenol, a dodecylphenol, a dioctylphenol, a triheptylphenol, a resorcinol a pyrogallol or mixtures thereof. In one embodiment the polyol includes an ethylene glycol, a propylene glycol, a butylene glycol, a trimethylene glycol, a glycerol, trimetholpropane (TMP), a pentaerythritol, an erythritol, an arabitol, a sorbitol, a mannitol or mixtures thereof.

Other suitable polyol compounds include a polyglycol such as a diethylene glycol, a triethylene glycol, a tetraethylene glycol, a dipropylene glycol, a tripropylene glycol, a dibutylene glycol, a tributylene glycol, a 1,2-cyclohexanediol, a 1,4-cyclohexanediol, a 1,4-(2-hydroxyethyl)-cyclohexane, a 1,4-di(2-hydroxyethyl)-benzene, a dipentaerythritol, a glucose, an arabitose, a ramnose, a mannose, a galactose or mixtures thereof.

The polyoxyalkylene alcohol includes those prepared by reacting a polyhydric alcohol with an alkylene oxide forming a "block" polymer. The alkylene oxide contains in one embodiment about 2 to about 8, in another embodiment about 2 to 6 and in yet another embodiment about 2 to 4 carbon atoms. The polyoxyalkylene alcohol includes those with a number average molecular weight in one embodiment of about 1000 to about 10,000, in another embodiment about 1500 to about 8000 and in yet another embodiment about 2000 to about 7000.

The substantially nitrogen free dispersant is present on an oil free basis from about 0.01 wt % to about 30 wt %, in one embodiment about 0.1 wt % to about 5 wt %, in another embodiment about 0.15 wt % to about 2.5 wt % and in yet another embodiment about 0.2 wt % to about 1 wt % of the composition. In one embodiment the substantially nitrogen free dispersant is present on an oil free basis at about 16 wt %.

Primary Metal Hydrocarbyl Dithiophosphate

In one embodiment the composition contains a primary metal hydrocarbyl dithiophosphate that may be neutral and/or basic. The metal hydrocarbyl dithiophosphate includes those represented by the formula:

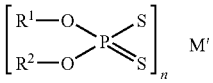

(XIV)

wherein $R^1$ and $R^2$ are independently hydrogen, hydrocarbyl groups or mixtures thereof, provided that at least one of $R^1$ and $R^2$ is a hydrocarbyl group, with the proviso that the hydrocarbyl group contains a carbon atom with a C—H bonded directly to the oxygen of a dithiophosphate group. This forms on the dithiophosphate a —CH—O—P structural unit.

M' is a metal, and n is an integer equal to the available valence of M'. M' is mono- or di- or tri-valent, in one embodiment divalent and in anther embodiment a divalent transition metal. In one embodiment M' is zinc. In one embodiment M' is calcium. In one embodiment M' is barium. M' may be used alone or in combination.

The hydrocarbyl group contains in one embodiment 1 to about 30 carbon atoms, in another embodiment about 2 to about 20 carbon atoms and in yet another embodiment about 2 to about 15 carbon atoms. The hydrocarbyl group includes alkyl and may be linear or branched. Examples of a suitable hydrocarbyl group include isobutyl, pentyl, hexyl, heptyl, octyl, 2-ethylhexyl, nonyl, decyl, undecyl, dodecyl or mixtures thereof.

Examples of a primary metal hydrocarbyl dithiophosphate include a primary zinc dihydrocarbyl dithiophosphate (often referred to as ZDDP, ZDP or ZDTP). Examples of suitable a primary metal hydrocarbyl dithiophosphate include zinc di-(heptyl) dithiophosphate, zinc di-(octyl) dithiophosphate, zinc di-(2-ethylhexyl) dithiophosphate, zinc di-(nonyl) dithiophosphate, zinc di-(decyl) dithiophosphate, zinc di-(dodecyl) dithiophosphate or mixtures thereof.

The primary metal hydrocarbyl dithiophosphate is present on an oil free basis from about 0.01 wt % to about 30 wt %, in one embodiment about 0.1 wt % to about 5 wt %, in another embodiment, about 0.2 wt % to about 4 wt % and in yet another embodiment about 0.4 wt % to about 2 wt % of the composition.

Viscosity Modifiers

As used herein the term "(meth)acrylate" includes a methacrylate and/or an acrylate.

Viscosity modifiers (often referred to as viscosity index improvers) of the invention are known and include polymeric materials including a styrene-butadiene rubber, an olefin copolymer, a hydrogenated styrene-isoprene polymer, a hydrogenated radical isoprene polymer, a poly(meth)acrylate acid ester, a polyalkylstyrene, an alkenylaryl conjugated-diene copolymer, an ester of maleic anhydride-styrene copolymer or mixtures thereof.

The viscosity modifiers include poly(meth)acrylate acid ester, an olefin copolymer or mixtures thereof.

Poly(meth)acrylate acid ester viscosity modifiers include copolymers of (a) a (meth)acrylic acid ester containing about 9 to about 30 carbons in the ester group, (b) a (meth)acrylic acid ester containing about 7 to about 12 carbons in the ester group wherein the ester group contains a 2-($C_{1-4}$ alkyl)-substituents and optionally (c) at least one monomer including a (meth)acrylic acid ester containing from 2 to about 8 carbon atoms in the ester group and which are different from (meth) acrylate acid esters used in (a) and (b) above. In one embodiment the (meth)acrylate is a methacrylate.

Viscosity modifiers derived from an olefin copolymer. The olefin copolymer includes those with a backbone containing about 2 to about 4 different olefin monomers, in one embodiment about 2 to about 3 different olefin monomers and in yet another embodiment 2 different olefin monomers. The olefin monomers include about 2 to about 20, in one embodiment about 2 to about 10, in another embodiment about 2 to about 6 and in yet another embodiment about 2 to about 4 carbon atoms.

The olefin copolymer includes an ethylene monomer and at least one other comonomer derived from an alpha-olefin having the formula $H_2C{=}CHR^3$, wherein $R^3$ is a hydrocarbyl group, in one embodiment an alkyl radical containing 1 to about 18, in one embodiment 1 to about 10, in another embodiment 1 to about 6 and in yet another embodiment 1 to about 3 carbon atoms. The hydrocarbyl group includes an alkyl radical that has a straight chain, a branched chain or mixtures thereof.

Examples of a suitable comonomer include propylene, 1-butene, 1-hexene, 1-octene, 4-methylpentene-1,1-decene, 1-dodecene, 1-tridecene, 1-tetradecene, 1-pentadecene, 1-hexadecene, 1-heptadecene, 1-octadecene, 1-nonadecene or mixtures thereof. The comonomer includes 1-butene, propylene or mixtures thereof. Examples of the olefin copolymers include ethylene-propylene copolymers, ethylene-butene-1 copolymers or mixtures thereof.

The viscosity modifiers are present on an oil free basis at of about 0 wt % to about 30 wt %, in one embodiment about 0.1 wt % to about 30 wt %, in another embodiment about 1 wt % to about 25 wt %, in another embodiment about 3 wt % to about 20 wt % and in yet another embodiment about 5 wt % to about 12 wt % of the composition. In one embodiment the viscosity modifier is present. In one embodiment the viscosity modifier is absent.

Oils of Lubricating Viscosity

The lubricating oil composition includes natural or synthetic oils of lubricating viscosity, oil derived from hydrocracking, hydrogenation, hydrofinishing, unrefined, refined and re-refined oils or mixtures thereof.

Natural oils include animal oils, vegetable oils, mineral oils or mixtures thereof. Synthetic oils include a hydrocarbon oil, a silicon-based oil, a liquid esters of phosphorus-containing acid. Synthetic oils may be produced by Fischer-Tropsch reactions and typically may be hydroisomerised Fischer-Tropsch hydrocarbons or waxes Oils of lubricating viscosity may also be defined as specified in the American Petroleum Institute (API) Base Oil Interchangeability Guidelines. In one embodiment the oil of lubricating viscosity comprises an API Group I, II, III, IV, V or mixtures thereof, and preferably API Group I, II, III or mixtures thereof. If the oil of lubricating viscosity is an API Group II, III, IV or V oil there may be up to about 40 wt % and most preferably up to a maximum of about 5 wt % of the lubricating oil an API Group I oil.

The oil of lubricating viscosity is present from about 50 wt % to about 99.9 wt %, in one embodiment about 60 wt % to about 98.9 wt %, in another embodiment about 70 wt % to about 97 wt % and in yet another embodiment about 80 wt % to about 95 wt % of the composition.

If the present invention is in the form of a concentrate (which can be combined with additional oil to form, in whole or in part, a finished lubricant), the ratio of each of the above-mentioned dispersant, as well as other components, to diluent oil include about 80:20 to about 10:90 by weight.

Other Performance Additive

The composition of the invention optionally further includes at least one other performance additive. The other performance additive compounds include a metal deactivator, a detergent, an antioxidant, a corrosion inhibitor, an antiscuffing agent, a foam inhibitor, a demulsifiers, a pour point depressant, a seal swelling agent or mixtures thereof. In one embodiment the composition further includes at least one compound including the group consisting of a metal deactivator, a detergent and an antioxidant. In one embodiment the composition further includes at least two compounds including a metal deactivator, a detergent or an antioxidant. In one embodiment the composition further includes a metal deactivator, a detergent and an antioxidant.

The total combined amount of the other performance additive compounds present on an oil free basis is from about 0 wt % to about 25 wt %, in one embodiment about 0.01 wt % to about 20 wt %, in another embodiment about 0.04 wt % to about 15 wt % and in yet another embodiment about 0.06 wt % to about 10 wt % of the composition. Although one or more of the other performance additives may be present, it is common for the other performance additives to be present in different amounts relative to each other.

Metal Deactivator

The composition of the invention optionally includes a metal deactivator. The metal deactivator may be used to neutralise the catalytic effect of metal for promoting oxidation in lubricating oil. Examples of a metal deactivator include derivatives of benzotriazoles, 1,2,4-triazoles, benzimidazoles, 2-alkyldithiobenzimidazoles, 2-alkyldithiobenzothiazoles, 2-(N,N-dialkyldithiocarbamoyl)benzothiazoles, 2,5-bis(alkyl-dithio)-1,3,4-thiadiazoles, 2,5-bis(N,N-dialkyldithiocarbamoyl)-1,3,4-thiadiazoles, 2-alkyldithio-5-mercapto thiadiazoles or mixtures thereof. The metal deactivator may be used alone or in combination with other metal deactivators.

Examples of suitable a benzotriazole include those with hydrocarbyl group with substitutions on at least one ring position, such as, position 1- or 2- or 4- or 5- or 6- or 7- or mixtures thereof. The hydrocarbyl group includes 1 to about 30 carbon atoms, in one embodiment 1 to about 15 carbon atoms, in another embodiment 1 to about 7 carbon atoms. In one embodiment the benzotriazole is 5-methylbenzotriazole (tolyltriazole) or mixtures thereof. In one embodiment hydrocarbyl benzotriazole may be substituted at positions 4- or 5- or 6- or 7- and further reacted with an aldehyde and a secondary amine to form a Mannich product such as N,N-bis(heptyl)-ar-methyl-1H-benzotriazole-1-methanamine; N,N-bis(nonyl)-ar-methyl-1H-benzotriazole-1-methanamine.

When the metal deactivator is a 2,5-bis(alkyl-dithio)-1,3,4-thiadiazole or 2-monoalkyl-dithio-mercapto-1,3,4-thiadiazole the alkyl groups includes 1 to about 30 carbon atoms, in one embodiment about 2 to about 25 carbon atoms, in another embodiment about 4 to about 20 and in yet another embodiment about 6 to about 16 carbon atoms. Examples of a suitable 2,5-bis(alkyl-dithio)-1,3,4-thiadiazole include 2,5-bis(alkyl-dithio)-1,3,4-thiadiazole is a 2,5-bis(tert-nonyldithio)-1,3,4-thiadiazole or mixtures thereof. Examples of a suitable 2-monoalkyl-dithio-mercapto-1,3,4-thiadiazole include 2-monononyl-dithio-mercapto-1,3,4-thiadiazole, 2-monododecyl-dithio-mercapto-1,3,4-thiadiazole or mixtures thereof.

The metal deactivator is present on an oil free basis from about 0 wt % to about 5 wt %, in one embodiment about 0.01 wt % to about 2 wt %, in another embodiment, about 0.02 wt % to about 0.5 wt % and in yet another embodiment about 0.03 wt % to about 0.1 wt % of the composition.

Detergent

The composition of the invention may further include a detergent. Detergent compounds are known and include neutral or overbased, Newtonian or non-Newtonian, basic salts of alkali, alkaline earth and transition metals with one or more of a phenate, a sulphurised phenate, a sulphonate, a carboxylic acid, a phosphorus acid, a mono- and/or a di-thiophosphoric acid, a saligenin, a salixarate, an alkylsalicylate or mixtures thereof. Commonly used metals include sodium, potassium, calcium, magnesium lithium or mixtures thereof. Most commonly used metals include sodium, magnesium and calcium. In one embodiment the detergent include a phenate, a sulphurised phenate or mixtures thereof. In one embodiment the detergent is a sulphurised phenate.

The detergent is present on an oil free basis from about 0 wt % to about 10 wt %, in one embodiment about 0.01 wt % to about 2 wt %, in another embodiment, about 0.02 wt % to about 0.5 wt % and in yet another embodiment about 0.03 wt % to about 0.2 wt % of the composition.

Antioxidant

The composition of the invention may further include an antioxidant. The antioxidant compounds are known and include a molybdenum dithiocarbamate, a sulphurised olefin, a hindered phenol, a diphenylamine or mixtures thereof. The antioxidant can be used alone or in combination. In one embodiment the antioxidants include a hindered phenol, a diphenylamine or mixtures thereof.

The diphenylamine antioxidant includes those with a mono- or a di-alkylated phenyl ring. Examples of suitable diphenylamine antioxidant include bis-nonylated diphenylamine, nonyl diphenylamine, octyl diphenylamine, bis-octylated diphenylamine, bis-decylated diphenylamine, decyl diphenylamine or mixtures thereof.

The hindered phenol antioxidant includes a secondary butyl and/or a tertiary butyl group as a sterically hindering group. The phenol group is further substituted with a hydrocarbyl group and/or a bridging group linking to a second aromatic group. Examples of suitable hindered phenol antioxidant include 2,6-di-tert-butylphenol, 4-methyl-2,6-di-tert-butylphenol, 4-ethyl-2,6-di-tert-butyiphenol, 4-propyl-2,6-di-tert-butylphenol, 4-butyl-2,6-di-tert-butylphenol 2,6-di-tert-butylphenol, 4-pentyl-2,6-di-tert-butylphenol, 4-hexyl-2,6-di-tert-butylphenol, 4-heptyl-2,6-di-tert-butylphenol, 4-(2-ethylhexyl)-2,6-di-tert-butylphenol, 4-octyl-2,6-di-tert-butylphenol, 4-nonyl-2,6-di-tert-butylphenol, 4-decyl-2,6-di-tert-butylphenol, 4-undecyl-2,6-di-tert-butylphenol, 4-dodecyl-2,6-di-tert-butylphenol, 4-tridecyl-2,6-di-tert-butylphenol, 4-tetradecyl-2,6-di-tert-butylphenol, 4,4'-methylene-bis-(6-tert-butyl-o-cresol), 4,4'-methylene-bis-(2-tert-amyl-o-cresol), 4,4'-methylene-bis-(2,6-di-tert-butyl-phenol), 2,2'-methylene-bis-(4-methyl-6-tert-butylphenol), 2,2'-methylene-bis-(4-ethyl-6-tert-butylphenol), 2,2'-methylene-bis-(4-propyl-6-tert-butylphenol) or mixtures thereof.

Suitable examples of molybdenum dithiocarboamate include commercial materials sold under the trade names such as Vanlube 822™ and Molyvan™ A from R. T. Vanderbilt Co., Ltd., and Adeka Sakura-Lube™ S-100 and S-165 and S-600 from Asahi Denka Kogyo K. K.

The antioxidant is present on an oil free basis from about 0 wt % to about 30 wt %, in one embodiment about 0.1 wt % to about 5 wt %, in another embodiment, about 0.2 wt % to about 4 wt % and in yet another embodiment about 0.3 wt % to about 2 wt % of the composition.

The other performance additive compounds such as a corrosion inhibitor include octylamine octanoate, condensation products of dodecenyl succinic acid or anhydride and a fatty acid such as oleic acid with a polyamine; a foam inhibitor include poly ethyl acrylate, poly 2-ethylhexylacrylate and poly vinyl acetate; a demulsifier include trialkyl phosphates, polyethylene glycols, polyethylene oxides, polypropylene oxides and (ethylene oxide-propylene oxide) polymers; a pour point depressant include esters of maleic anhydride-styrene, polymethacrylates, polyacrylates or polyacrylamides; and a seal swell agent include Exxon Necton-37™ (FN 1380) and Exxon Mineral Seal Oil (FN 3200); may also be used in the composition of the invention.

The invention further provides a method for lubricating a vehicle hydraulic system capable of transferring rotational energy into a stored energy reservoir and later reconverting the stored energy to rotational energy to aid propulsion, the method employing a composition comprising:

(a) a substantially nitrogen free dispersant derived from the reaction product of:
  (i) a polyalkenyl-substituted acylating agent; and
  (ii) a polyol; and
(b) an oil of lubricating viscosity.

In one embodiment the composition of the method further includes a viscosity modifier.

Examples of vehicle hydraulic system capable of transferring rotational energy into a stored energy reservoir and later reconverting the stored energy to rotational energy to aid propulsion include a Hydraulic Launch Assist® (HLA), a hydrostatic transmission or mixtures thereof.

Hydraulic Launch Assist apparatus are known in the art and commercially available from Eaton Corporation. The system includes a hybrid hydraulic braking system that recovers heat energy generated during braking. The heat energy is stored and later used to partially or wholly replace power generated by an engine to generate rotational energy to aid propulsion. A more detailed description of the Hydraulic Launch Assist apparatus is disclosed in SAE International Topical Technical Symposium on "Emerging Transmission Technologies TOPTEC® Symposium, Aug. 12-13, 2003, Michigan State University, Troy, Mich., ID#2003TT14.

A hydrostatic transmission is known in the art and include a variable displacement pump and a fixed or variable displacement motor. The displacement pump and motor operate together in one embodiment in a closed circuit and in another embodiment in an open circuit. In a closed circuit, a hydraulic fluid from the motor flows to a pump inlet without returning to a tank. The transmission equipment pressurises a fluid during braking by recovering heat energy and later reuses the energy to partially or wholly replace power generated by an engine to generate rotational energy to aid propulsion.

Process

The invention further provides a process for the preparation of a composition comprising mixing:

(a) a substantially nitrogen free dispersant derived from the reaction product of:
  (i) a polyalkenyl-substituted acylating agent; and
  (ii) a polyol;
(b) a primary metal hydrocarbyl dithiophosphate;
(c) an oil of lubricating viscosity; and
(d) optionally a viscosity modifier, wherein the composition contains about 35 ppm or less of nitrogen derived from a substantially nitrogen free dispersant.

Components (a)-(d) are mixed sequentially and/or separately to form the composition of the invention. The mixing conditions include a temperature of about 15° C. to about 130° C., in one embodiment about 20° C. to about 120° C. and in anther embodiment about 25° C. to about 110° C.; and for a period of time in the range about 30 seconds to about 48 hours, in one embodiment about 2 minutes to about 24 hours, in another embodiment about 5 minutes to about 16 hours and in yet another embodiment about 10 minutes to about 5 hours; and at pressures in the range about 86 kPa to about 266 kPa (about 650 mm Hg to about 2000 mm Hg), in one embodiment about 91 kPa to about 200 kPa (about 690 mm Hg to about 1500 mm Hg), and in another embodiment about 95 kPa to about 133 kPa (about 715 mm Hg to about 1000 mm Hg).

The process optionally includes mixing other optional performance additives as described above. The optional performance additives may be added sequentially, separately or as a concentrate.

INDUSTRIAL APPLICATION

The composition of the present invention is useful in a hydraulic fluid. In one embodiment the hydraulic fluid is suitable for hydraulic launch assist apparatus. In one embodiment the hydraulic fluid is for a hydrostatic transmission.

The use of the composition of the invention imparts one or more performance characteristics including improved cleanliness, decreased wear, improved shear stability, improved low temperature viscometrics, high temperature viscometrics or long life. Increased long life is defined to mean no refill is necessary during the working life of the vehicles fitted with the hydraulic apparatus.

The following examples provide an illustration of the invention. These examples are non exhaustive and are not intended to limit the scope of the invention.

EXAMPLES

Example 1

Example 1 was prepared by mixing about 1 wt % of antioxidant; about 1 wt % of a primary zinc dithiophosphate; about 1 wt % of a substantially nitrogen free dispersant free prepared by the reaction product of a polyisobutenyl succinic anhydride and pentaerythritol; about 0.06 wt % of metal deactivator; about 0.1 wt % of detergent; and about 8.3 wt % of a polymethacrylate viscosity modifier into an oil of lubricating viscosity containing about 52 wt % of PetroCanada™ 6 cSt, about 34 wt % of PetroCanada™ 6 cSt and about 3.5 wt % of diluent oil.

Example 2

Example 2 was prepared in the same way as Example 1, except the amount of antioxidant is about 0.2 wt % and a polymethacrylate viscosity modifier present at about 9 wt % in an oil of lubricating viscosity containing about 70 wt % of an Exxon Mobil 160N API Group II base oil and about 30 wt % of an Exxon Mobile 100N-120N API Group II base oil. Furthermore no metal deactivator is present.

Example 3

Example 3 was prepared in the same way as Example 1, except the amount of polymethacrylate viscosity modifier is about 10 wt %.

Example 4

Example 4 was prepared in the same way as Example 1, except the composition contains about 0.06 wt % of metal deactivator; is free of viscosity modifier; about 0.2 wt % of a polymethacrylate pour point depressant; and 100 wt % the oil of lubricating viscosity is an API Group II 160N, Exxon Mobil (EHC60) base oil.

Reference Example 1

Reference Example 1 was prepared by mixing about 0.2 wt % of antioxidant; about 0.5 wt % of a primary zinc dithiophosphate; 0.01 wt % corrosion inhibitor into an oil of lubricating viscosity containing about 100 wt % a Chevron RLOP 220N oil.

Reference Example 2

Reference Example 2 was prepared in a similar manner to Reference Example 1, except about 0.0015 wt % of tolyltriazole was added and the oil of lubricating viscosity is about 63 wt % of 150N Exxon oil and about 37 wt % of 600N Exxon oil.

Test 1: Foaming Test

The foaming Test was carried out according to the ASTM method D892-03, subsection 10 which measures foaming at 3 different sequences. The foaming of the first sequence is determined by decanting without mechanical shaking or stirring about 200 ml of sample into a beaker. The sample is then heated to about 49° C. and then allowed to cool to about 24° C. The sample is then poured into beaker with about 1 litre of volume until about 190 ml of sample have been added. The beaker is then immersed in a bath with a constant temperature of about 24° C. When the oil reaches the bath temperature a gas diffuser and gas inlet tube were inserted. A gas flow of about 94 ml $min^{-1}$ is then flowed through the sample for about 5 minutes after the first sign of bubbles then the gas supply is closed of. The volume of foam created is then measured. The results obtained from this test indicate that no foam is produced.

The second sequence uses a similar process to the first sequence except, a fresh sample of about 180 ml is added to a clean beaker and then bath is heated to about 93° C. The results obtained from this test indicate that no foam is produced.

The third sequence uses the sample of sequence 2 and cools it to below about 43.5° C. and then further cooling to about 24° C. The same experimental procedure used in sequence 1 was then used to evaluate the amount of foaming. The results obtained from this test indicate that no foam is produced.

Test 2: Water Separability Test

The separability test was carried out according to the ASTM method D1401-02. A sample containing about 40 ml of the composition of the invention and about 40 ml of distilled water are stirred for about 5 minutes at about 54° C. in a graduated cylinder. The sample is this then left to stand for about 30 minutes to allow a degree of separation of water and the composition of the invention to occur. The amount degree of separation is measured after every 5 minutes of the test. The results reported are based on X-Y-Z, where X indicates the amount of oil separated out, Y indicates the amount of water separated out and Z indicates the amount of oil and water still in an emulsion. The results obtained from the separability test at about 54° C. are presented in Table 1:

| | Time (mins) | | | | | | |
|---|---|---|---|---|---|---|---|
| | 0 | 5 | 10 | 15 | 20 | 25 | 30 |
| Example 1 | 0-0-80 | 0-8-72 | 0-8-72 | 0-8-72 | 0-8-72 | 0-8-72 | 0-8-72 |
| Example 4 | 0-0-80 | 0-1-79 | 0-1-79 | 0-2-78 | 0-2-78 | 0-2-78 | 0-2-78 |

Test 3: Oxidation Lifetime Test

The oxidation lifetime test was carried out according to the ASTM method D943-02. About 300 ml of sample was added into an oxidation cell and contacted with oxygen in the presence of water and an iron-copper catalyst at about 95° C. The test continues until the measured acid number of the sample increased by about 2.0 mg KOH $g^{-1}$ or above. The oxidation lifetime of the sample is determined to be equivalent to the total number of hours the test is run. The results obtained for the oxidation lifetime were:

| Example | Oxidation Lifetime (Hours) |
|---|---|
| Example 2 | 7392 |
| Example 3 | 12096 |
| Reference Example 1 | 5376 |
| Reference Example 2 | 2352 |

Overall the results indicate that the composition of the invention is useful for a hydraulic fluid, especially a vehicle hydraulic system capable of transferring rotational energy into a stored energy reservoir and later reconverting the stored energy to rotational energy to aid propulsion.

While the invention has been explained, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method for lubricating a vehicle hydraulic system capable of transferring rotational energy into a stored energy reservoir and later reconverting the stored energy to rotational energy to aid propulsion, the method employing a composition comprising:

(a) about 0.2 wt % to about 1 wt % of a substantially nitrogen free dispersant derived from the reaction product of:

(i) a polyalkenyl-substituted acylating agent, wherein the polyalkenyl-substituted acylating agent is polyisobutenyl succinic anhydride; and (ii) a polyol, wherein the polyol is pentaerythritol;

(b) an oil of lubricating viscosity; and (c) about 0.4 wt % to about 2 wt % of a zinc hydrocarbyl dithiophosphate wherein component (c) consists essentially of primary zinc hydrocarbyl dithiophosphates.

2. The method of claim 1, wherein the vehicle hydraulic system is a hydraulic launch assist, a hydrostatic transmission or mixtures thereof.

3. The method of claim 1, wherein component (a) is free of nitrogen.

4. The method of claim 1 wherein the composition further comprises a viscosity modifier.

5. The method of claim 1, wherein the substantially nitrogen free dispersant contains a polyalkenyl group with a number average molecular weight of about 500 to about 5000.

6. The method of claim 1, wherein the primary metal hydrocarbyl dithiophosphate is a primary zinc dihydrocarbyl dithiophosphate with each hydrocarbyl group containing about 2 to about 20 carbon atoms.

7. The method of claim 6, wherein the primary metal hydrocarbyl dithiophosphate is includes zinc di-(heptyl) dithiophosphate, zinc di-(octyl) dithiophosphate, zinc di-(2-ethylhexyl) dithiophosphate, zinc di-(nonyl) dithiophosphate, zinc di-(decyl) dithiophosphate, zinc di-(dodecyl) dithiophosphate or mixtures thereof.

8. The method of claim 1, wherein the viscosity modifier include a poly(meth)acrylate acid ester, an olefin copolymer or mixtures thereof.

9. The method of claim 1, wherein the oil of lubricating viscosity includes an API Group II, III or IV oil or mixtures thereof.

10. The method of claim 1, wherein the composition further comprises at least one other performance additive including a metal deactivator, a detergent and an antioxidant.

11. The method of claim 10, wherein the metal deactivator is a benzotriazole with a hydrocarbyl group substitution on at least one ring position.

12. The method of claim 10, wherein the detergent is a phenate, a sulphurised phenate or mixtures thereof.

13. The method of claim 10, wherein the antioxidant includes a hindered phenol, a diphenylamine or mixtures thereof.

* * * * *